US005690476A

United States Patent [19]

Miller

[11] Patent Number: 5,690,476

[45] Date of Patent: Nov. 25, 1997

[54] SAFETY DEVICE FOR AVOIDING ENTRAPMENT AT A WATER RESERVOIR DRAIN

[76] Inventor: Bernard J. Miller, 882 Andorra Rd., Lafayette Hills, Pa. 19444

[21] Appl. No.: 738,222

[22] Filed: Oct. 25, 1996

[51] Int. Cl.[6] ..... F04B 49/06

[52] U.S. Cl. ..... 417/44.2; 417/44.3; 417/33; 4/504; 361/23

[58] Field of Search ..... 417/17, 33, 44.2, 417/44.3; 4/504; 361/23

[56] References Cited

U.S. PATENT DOCUMENTS

| | | | |
|---|---|---|---|
| 2,765,743 | 10/1956 | Hollinshead . | |
| 2,933,570 | 4/1960 | Tutthill . | |
| 3,292,547 | 12/1966 | Ward . | |
| 3,679,325 | 7/1972 | Yost . | |
| 3,702,742 | 11/1972 | Russell . | |
| 3,716,306 | 2/1973 | Martin, Sr. et al. . | |
| 3,999,890 | 12/1976 | Niedermeyer . | |
| 4,070,133 | 1/1978 | McCormick . | |
| 4,106,469 | 8/1978 | Dey | 123/198 DB |
| 4,115,878 | 9/1978 | Johnson et al. . | |
| 4,233,694 | 11/1980 | Janosko et al. . | |
| 4,372,226 | 2/1983 | Erlandsson | 110/238 |
| 4,453,476 | 6/1984 | Erlandsson | 110/346 |
| 4,476,889 | 10/1984 | Haynes . | |
| 4,620,835 | 11/1986 | Bell . | |
| 4,661,247 | 4/1987 | Weir et al. | 210/97 |
| 4,705,629 | 11/1987 | Weir et al. | 210/340 |
| 5,167,041 | 12/1992 | Burkitt, III . | |
| 5,347,664 | 9/1994 | Hamza et al. . | |
| 5,466,229 | 11/1995 | Elson et al. | 604/317 |

FOREIGN PATENT DOCUMENTS 343 746 6/1978 Germany .

OTHER PUBLICATIONS

Miller, B.J. The Development of Heart and Lung Machines *Surgery, Gynecology & Obstetrics* Mar. 1982 vol. 154, pp. 403–414.

*Primary Examiner*—Charles G. Freay
*Assistant Examiner*—Xuan M. Thai
*Attorney, Agent, or Firm*—Caesar, Rivise, Bernstein, Cohen & Pokotilow, Ltd.

[57] ABSTRACT

A safety device for avoiding entrapment at a water reservoir drain by using a vacuum operated switch to interrupt power to the reservoir pump whenever a blockage occurs. In addition, a manual reset switch requires human intervention to re-activate the reservoir pump once the blockage condition is removed.

9 Claims, 7 Drawing Sheets

SAFETY DEVICE FOR AVOIDING ENTRAPMENT AT A WATER RESERVOIR DRAIN

BACKGROUND OF THE INVENTION

This invention relates generally to a safety device used in pools, spas, jacuzzis and other such water reservoirs, and more particularly to water circulating pumps which avoid entrapment of a person or an object that may inadvertently block the pump intake or drain.

In water reservoirs such as pools, whirlpools and spas, a water pump is provided to extract the water from the pool or spa (e.g., through a pump inlet located at the drain of the pool or spa) and to re-circulate the water back into the pool or spa through the nozzles/jets located on the side of the pool or spa, thereby creating turbulence.

Personal contact with the drain can be dangerous, painful or even fatal. A typical drain is 5 to 8 inches in diameter. When the body or hair of a person is positioned in close proximity to the drain, the body or hair may completely block the drain opening thereby creating a vacuum. If the drain is blocked, the person may be entrapped and drowned.

Commonly used recirculating water pumps if obstructed (e.g., completely blocked by the body or hair of a person) can draw a partial vacuum at the drain opening that may exert sufficient suction forces to prevent a person from pulling free of the drain. Even if the person is able to pull free of the sucking drain, bruises or welts may result. In at least one case, a young girl drowned in a hot tub when her hair was caught and sucked into the drain.

Various types of safety devices for avoiding entrapment at the pump intake are commercially available and the patent literature includes various disclosures of such safety devices.

For example, U.S. Pat. No. 4,115,878 (Johnson, et al.) discloses a spa safety drain, which does not employ any springs, valves, electrical components or moving parts of any type, for preventing entrapment at the drain.

U.S. Pat. Nos. 5,167,041 (Burkitt, III) and 5,347,664 (Hamza, et al.) disclose suction fittings for use in a water circulation system that detect blockage to disable the pump in order to prevent damage or physical injury.

U.S. Pat. No. 4,620,835 (Bell) discloses a system to protect the water pump against running dry and against blockage at the drain. This system employs a pressure sensor and pressure switches for interrupting power to the water pump.

Another system that guards against complete occlusion of the intake to a pump has been employed in heart-lung machines, as disclosed in the article by Applicant *The Development of Heart-Lung Machines*, Surgery, Gynecology and Obstetrics, March 1982 at 403.

While some prior art safety devices for avoiding entrapment at the pump intake may be generally suitable for their intended purposes, they nevertheless leave something to be desired for one or more of the following standpoints: safety, reliability, simplicity of construction and cost.

OBJECTS OF THE INVENTION

Accordingly, it is the general object of the instant invention to provide a safety device for avoiding entrapment at the pump intake which meets the above-mentioned needs.

It is a further object of this invention to provide a safety device for avoiding entrapment by detecting blockage at the drain.

It is yet a further object of this invention to provide a safety device for avoiding entrapment which detects blockage at the drain and automatically de-activates the pump motor.

It is yet a further object of the present invention to provide a safety device for detecting a blockage and automatically sounding an alarm of the blockage.

It is another object of this invention to provide a safety device for avoiding entrapment, which has a manual reset button requiring human intervention to re-activate the pool pump once the blockage condition is removed.

SUMMARY OF THE INVENTION

These and other objects of the instant invention are achieved by providing an electrical circuit adapted to shut-off power to a water reservoir (e.g., pool, spa, whirlpool, etc.) pump having an intake, coupled in fluid communication to a water reservoir drain, whenever the drain becomes obstructed. The power is provided to the pump via first and second leads coupled between a power source and the pump. The electrical circuit comprises a relay comprising a drive coil having a first end coupled to the first lead of the power source and a second end coupled through the first associated switch to the second lead of the power source, thereby defining a first return path. Furthermore, the electrical circuit comprises a parallel return path coupling the second end of the drive coil to the second lead of the power source through a vacuum-operated switch that is coupled to the pump at the intake. The vacuum-operated switch permits a flow of current through the drive coil whenever the vacuum-operated switch experiences a partial vacuum draw of a predetermined pressure (e.g., −18 to −20 inches of mercury$_{gauge\ pressure}$) or greater partial vacuum. The first associated switch is closed whenever the flow of current exists. Finally, the second associated switch is coupled in series between the power source and the pump and whenever the flow of current exists, the second associated switch opens, thereby shutting-off power to the pump.

DESCRIPTION OF THE DRAWINGS

Other objects and many of the attendant advantages of this invention will be readily appreciated when the same becomes better understood by reference to the following detailed description, when considered in connection with the accompanying drawings wherein.

DETAILED DESCRIPTION OF THE PREFERRED EMBODIMENTS

Figure 1:
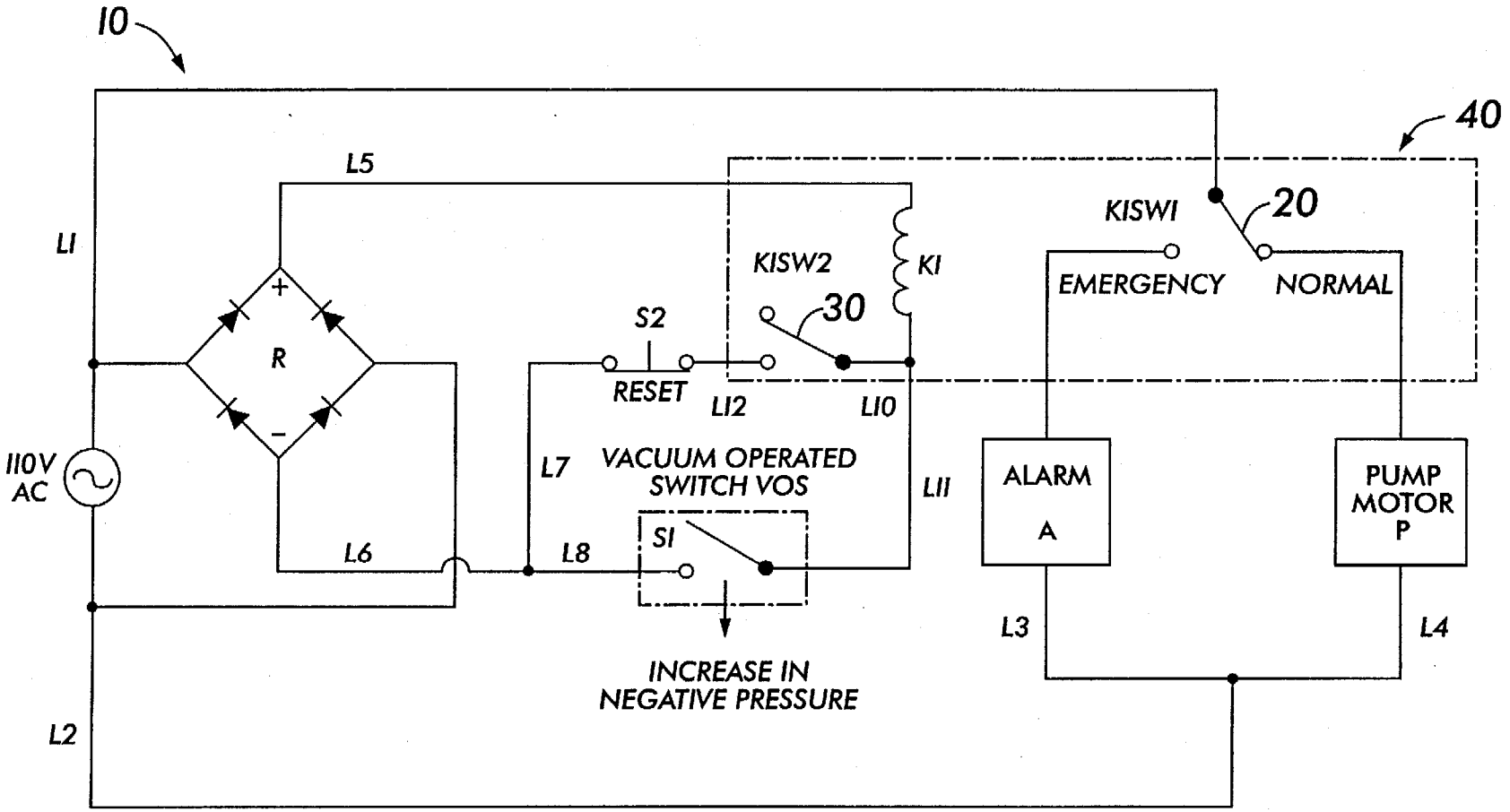
FIG. 1 is a schematic diagram of the safety device for avoiding entrapment at the pump intake constructed in accordance with this invention and operating under normal conditions.

Referring now in greater detail to the various figures, wherein like reference characters refer to like parts, there is shown in FIG. 1 a preferred embodiment of an electrical circuit for avoiding entrapment at the pump intake (drain) in a water reservoir by de-activating a pump motor P and activating an audible alarm A. The electrical circuit 10 comprises a vacuum-operated switch S1 (hereinafter "VOS SI"), a reset switch S2, a double pole double throw (hereinafter "DPDT") relay 40, an alarm A, and a rectifier bridge R configured to control the pump motor P.

Figure 2:
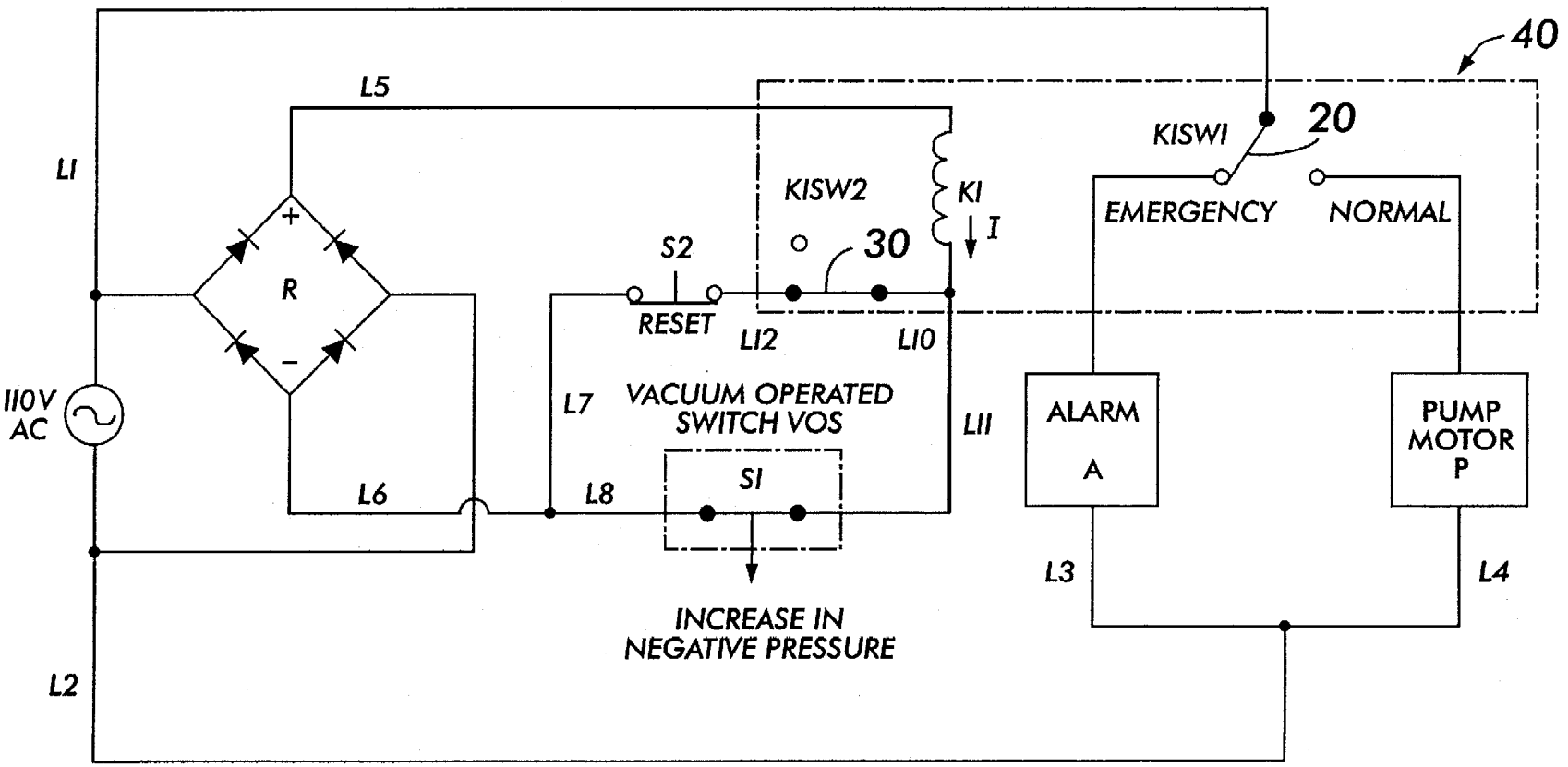
FIG. 2 is a schematic diagram, similar to FIG. 1, upon detection of a blockage condition.

The DPDT relay 40, e.g., the 110 VDC Relay DPDT #6454-1548 manufactured by Guardian, contains a coil K1 that drives switches K1SW1 and K1SW2. When the coil K1 is energized by a flow of current, an armature 20 of K1SW1 is driven from the "NORMAL"pole to the "EMERGENCY" pole (FIG. 2) and an armature 30 of K1SW2 is driven from a normally open state (FIG. 1) to a closed state (FIG. 2).

Figure 7:
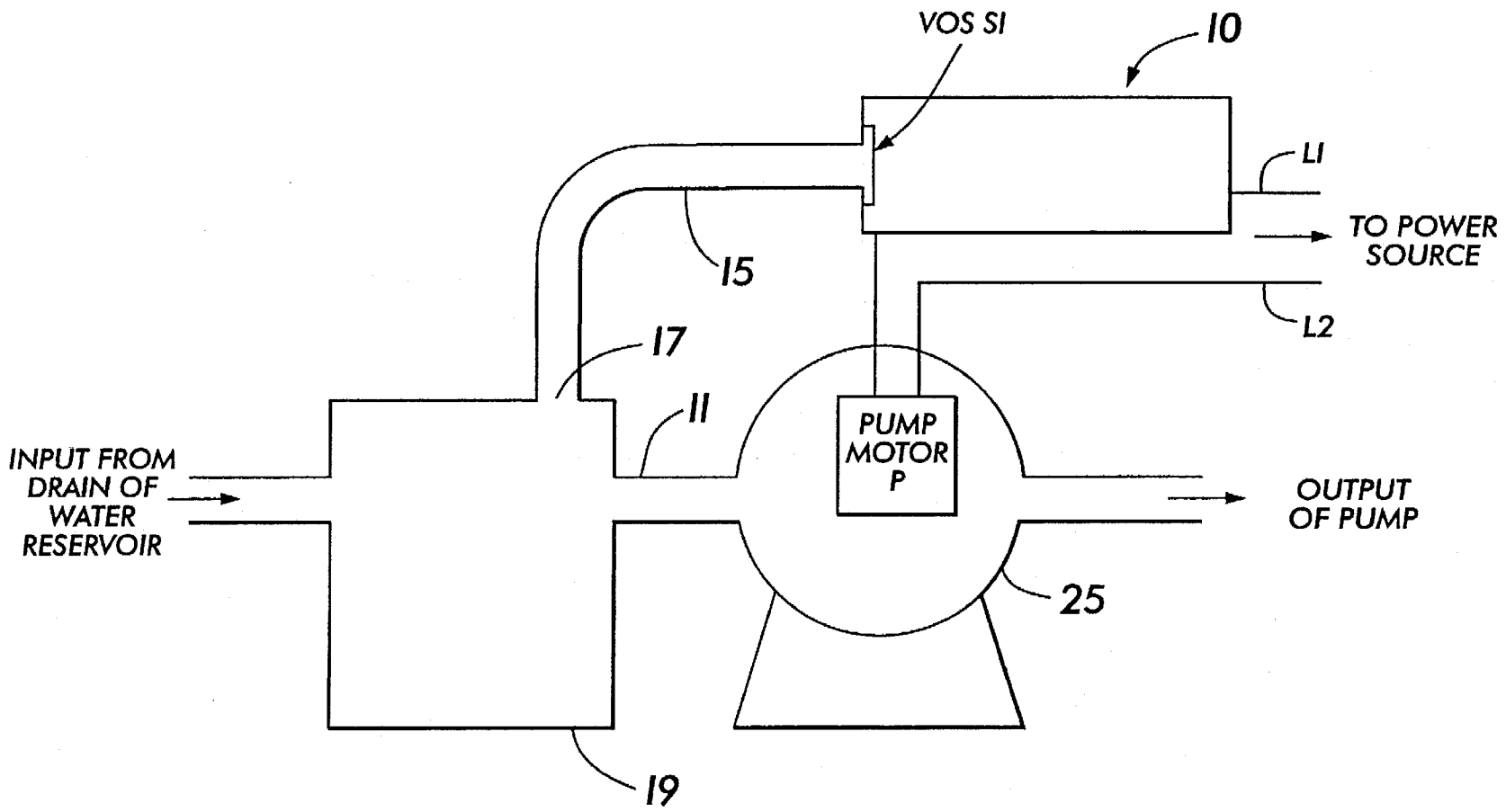
FIG. 7 is a representation of the location of the vacuum-operated switch.

The pump motor P is a conventional pump motor used in the pool industry having approximately ¾ horsepower. As stated previously, VOS S1 is a vacuum-operated switch, e.g., Vacuum Operated Switch #01 H-H18 manufactured by Barksdale Control. As shown in FIG. 7, the VOS S1 is in fluid communication with the intake 11 of the pump P via a tubing 15 which is coupled to a port 17 in a filter housing 19. It should be noted that the particular location of the port 17 is exemplary only and could be located at any point that is in fluid communication with the intake 11 of the pump P. The pump P, the filter housing 19, the tubing 15 and the electronic circuit 10 are all remotely located from the water reservoir (not shown).

As can be seen in FIG. 1, a 110 VAC power supply is applied to the rectifier R. The rectifier R comprises a single phase, full-wave, solid state (e.g., diode) bridge rectifier, e.g., the Full Wave Bridge Rectifier 400 PIV #276-1173 manufactured by Radio Shack. The positive output terminal of the rectifier R is connected by a line L5 to one side of the coil K1. The negative terminal of the rectifier R is connected by lines L6 and L7 to one side of the reset switch S2 and by lines L6 and L8 to one side of the VOS S1. The reset switch S2 is normally in the close position.

The other side of the coil K1 is connected by lines L10 and L11 to one side of the switch K1SW2 and the other side of the VOS S1, respectively. The other side of the switch K1SW2 is connected by line L12 to the other side of the reset switch S2. As shown in FIG. 1, switches K1SW2 and S2 are in series, the combination of which is in parallel to the VOS S1.

One end of the 110 VAC power supply is also connected by line L1 to one side of the switch K1SW1 and the other end of the 110 VAC power supply is connected by lines L2 and L3 to one side of the alarm A and by lines L2 and L4 to one side of the pump motor P. The alarm A and pump motor P are in parallel. The armature 20 of switch K1SW1 alternates between the emergency and normal positions making contact with the alarm A and pump motor P, respectively, as explained later.

During normal operation of the pool pump (as shown in FIG. 1), that is, when the drain (pump intake) is not blocked by a foreign object (e.g., skin or hair of a person), the pump draws a partial vacuum of approximately −8 inches of mercury$_{gauge\ pressure}$ at the intake 11. Under normal operation, the coil K1 is not energized and, therefore, the armature 30 of the switch K1SW2 remains open and the armature 20 of the switch K1SW1 remains in the normal position. When the armature 20 of the switch K1SW1 is in the normal position, the pump motor P is active, which re-circulates the water through the nozzles/jets on the side of the poor or spa. Since there is no connection to the alarm A when the armature 20 of the switch K1SW1 is in the normal position, the alarm A is not active during normal operation.

When the emergency condition arises (as shown in FIG. 2), that is, the drain is blocked by a foreign object, the pump increases the intensity of the partial vacuum to approximately −18 to −20 inches of mercury$_{gauge\ pressure}$ at the intake 11. This level of partial vacuum (blocked condition) causes VOS S1 to close, thereby providing a return path of the current I through the coil K1. During an emergency condition, the output of the rectifier R provides DC power to the coil K1, which energizes the coil K1. When the coil K1 is energized, the armature 20 of the switch K1SW1 switches to the emergency position and the armature 30 of the switch K1SW2 closes as shown in FIG. 2. The rectifier R maybe implemented by a Full Wave Bridge Rectifier 400PIV #276-1173 manufactured by Radio Shack.

When the armature 20 of switch K1SW1 is in the emergency position, the pump motor P is de-activated because no current is flowing through the pump motor P. As soon as the pump motor is de-activated, the alarm A is activated and it emits an audible sound. The alarm A can be any conventional 110 VAC audible alarm, siren or other annunciator.

Figure 3:
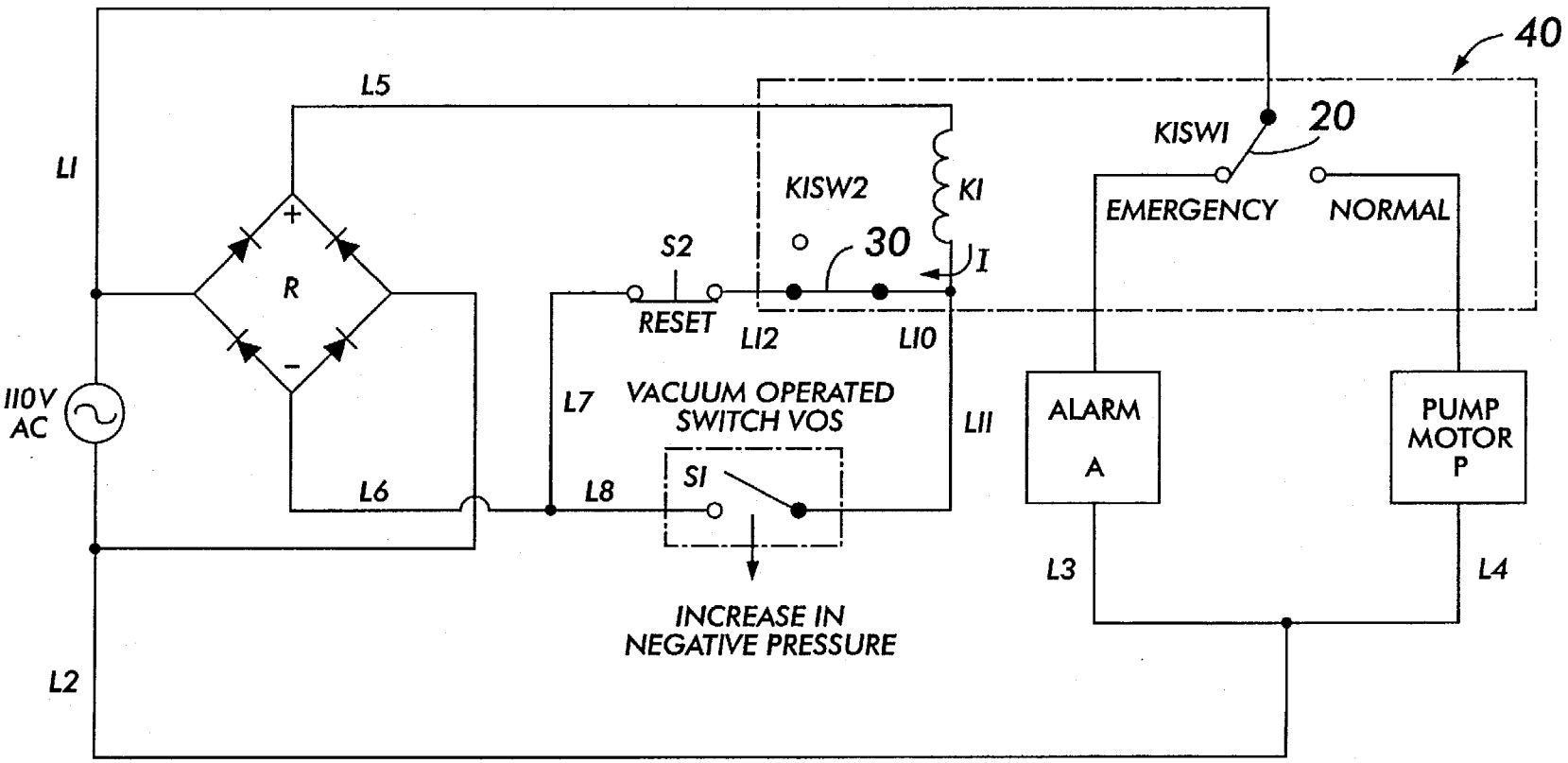
FIG. 3 is a schematic diagram similar to FIGS. 1 and 2 but operating under emergency (blockage) condition.

As soon as the pump motor P is de-activated, the VOS S1 opens because there is no longer a blockage condition at the drain, i.e., there is no longer a partial vacuum of approximately −18 to −20 inches of mercury$_{gauge\ pressure}$ at the intake 11. This is shown in FIG. 3 where the VOS S1 is in the open position and the armature 20 of the switch K1SW1 is in the emergency position and the armature 30 of the switch K1SW2 is in the closed position. During the emergency condition when the VOS S1 opens, the coil K1 remains energized because the current I flows through the coil K1 and the switches K1SW2 and S2.

Once the blockage condition is removed, the circuit 10 has to be manually reset to activate the pump motor P and de-activate the alarm A. This is accomplished by having someone press the reset switch S2 which, in turn, opens the armature 30 of the switch K1SW2. Resetting the circuit breaks the current flow through the coil K1 which causes the coil K1 to de-energize, thereby returning the armature 20 of the switch K1SW1 to the normal position for activating the pump motor P. Hence, the circuit 10 is restored to the condition shown in FIG. 1. Implementation of a manual reset switch assures that there is no automatic re-activation of the pump immediately after the blockage has been removed. An exemplary reset switch is the 110 VAC NC (normally closed) switch #275-1548 manufactured by Radio Shock.

The instant invention is particularly suitable for a pool or spa, but it could be also used in a whirlpool, hot tub and the like.

Figure 4:
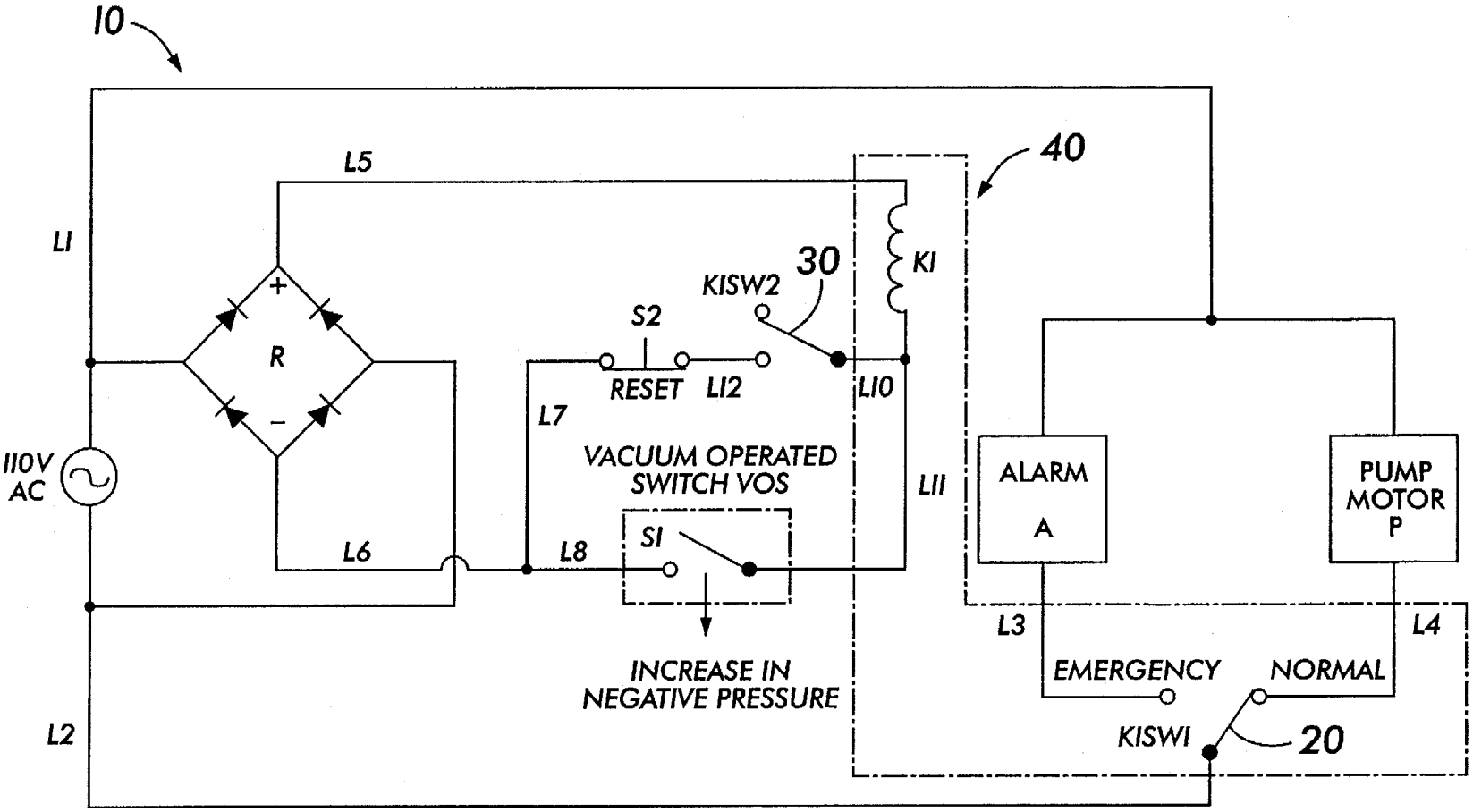
FIG. 4 is similar to FIG. 1 except that the switch controlling power to the pump is on the ground side of the pump.

As shown in FIG. 4, it is within the broadest scope of this invention to have the switch K1SW1, in the alternative, disposed on the L2-side of the power source.

Figure 5:
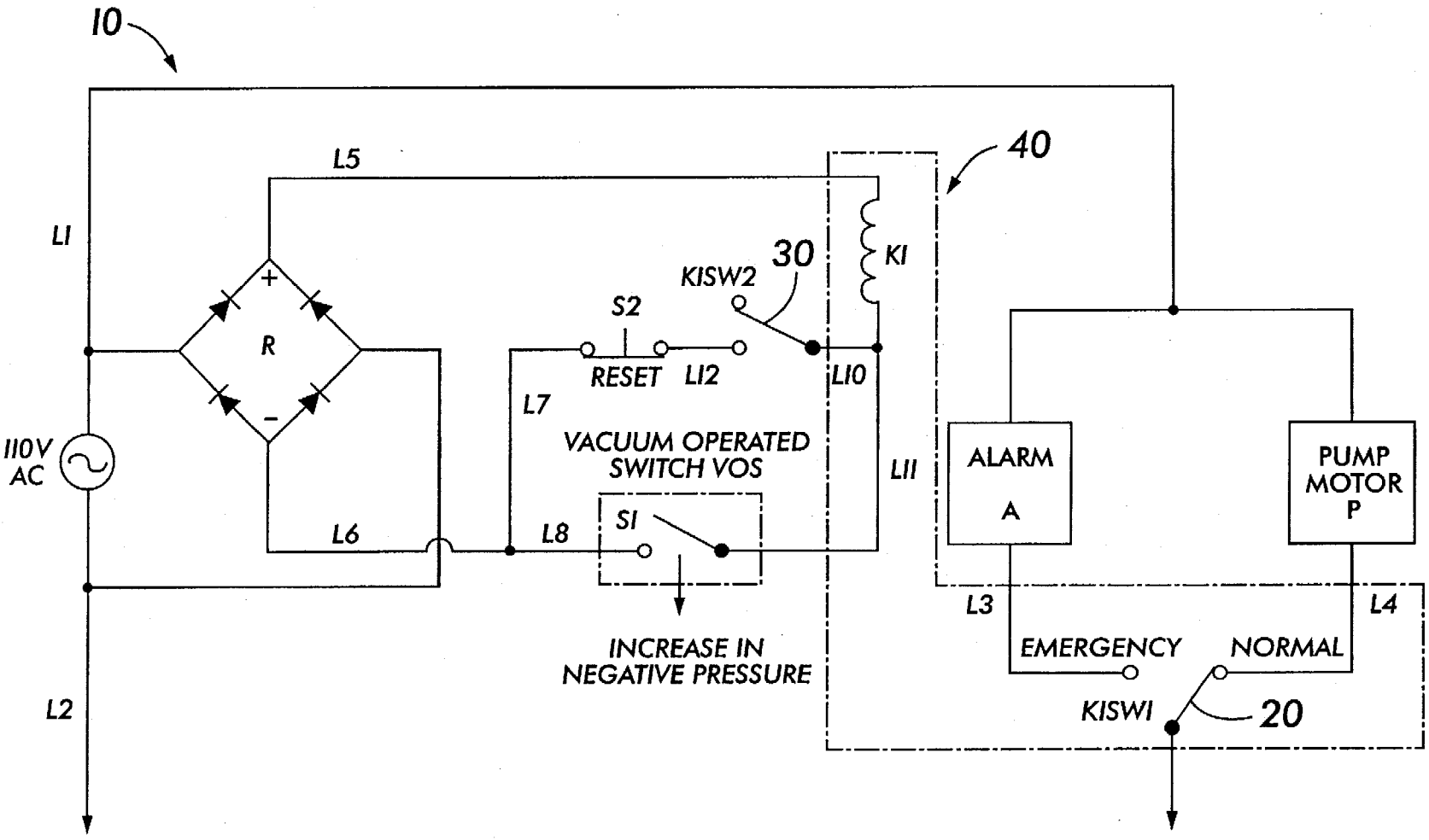
FIG. 5 is similar to FIG. 1 except that an indirect ground path is utilized between the power source and the pump.

As shown in FIG. 5, it is within the broadest scope of this invention that L2 is not limited to a direct connection to L3/L4. Any type of common ground configuration that electrically links L2 and L3/L4 is encompassed by the present invention. For example, the earth could form a portion of L2 for electrically linking it to L3/L4.

Figure 6:
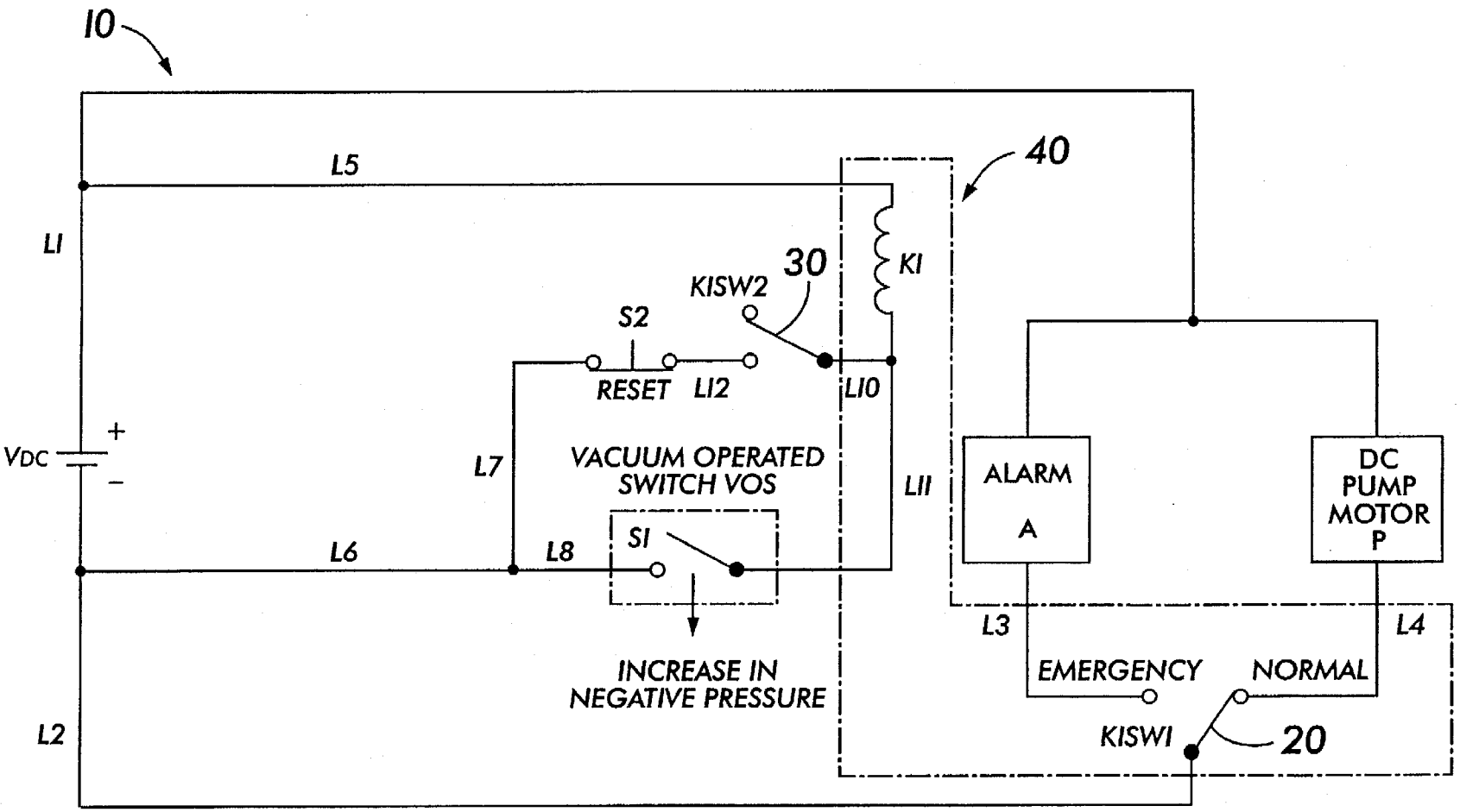
FIG. 6 is a DC implementation of the present invention when a DC pump motor is used.

As shown in FIG. 6, it is within the broadest scope of this invention to include the use of this electrical circuit 10 for controlling a DC pump motor. In this configuration, the drive coil K1 is directly coupled to the DC power source, $V_{DC}$, without the need for the rectifier R. In addition, the alarm A (either an audible alarm, a visual annunciator, or both) would be operable off of a DC power source.

Without further elaboration, the foregoing will so fully illustrate my invention and others may, by applying current or future knowledge, readily adapt the same for use under various conditions of service.

I claim:

1. An electrical circuit adapted to shut-off power to a water reservoir pump having an intake coupled in fluid communication to a water reservoir drain whenever the drain becomes obstructed, the power being provided to the pump via first and second leads coupled between a power source and the pump, said electrical circuit comprising:

a relay comprising a drive coil for driving a first associated switch and a second associated switch, said drive coil having a first end coupled to the first lead of the power source and a second end coupled through said first associated switch to the second lead of the power source, thereby defining a first return path;

a parallel return path coupling said second end of said drive coil to the second lead of the power source through a vacuum-operated switch that is disposed at the intake of the pump, said vacuum-operated switch permitting a flow of current through said drive coil and through said vacuum-operated switch whenever said vacuum-operated switch experiences a partial vacuum draw of a predetermined pressure or greater partial vacuum;

said first associated switch being closed whenever said flow of current exists;

and said second associated switch being coupled in series between the power source and the pump and whenever said flow of current exists said second associated switch opens, thereby shutting-off power to the pump.

2. The electrical circuit of claim 1 wherein said first return path further comprises a reset switch for interrupting said flow of current, thereby restoring power to the pump.

3. The electrical circuit of claim 1 wherein said second associated switch comprises a pole to which said switch is connected whenever said switch is opened, said pole being also coupled to one lead of an alarm, said alarm having another lead coupled to the second lead of the power source, said alarm being activated whenever said second associated switch is opened.

4. The electrical circuit of claim 3 wherein said parallel return path comprises a reset switch for interrupting said flow of current, thereby shutting off said alarm.

5. The electrical circuit of claim 1 wherein the power source is an AC power source and wherein said electrical circuit further comprises a rectifier coupled between the AC power source and said drive coil.

6. The electrical circuit of claim 5 wherein said first return path further comprises a reset switch for interrupting said flow of current, thereby restoring power to the pump.

7. The electrical circuit of claim 6 wherein said second associated switch comprises a pole to which said switch is connected whenever said switch is opened, said pole being also coupled to one lead of an alarm, said alarm having another lead coupled to the second lead of the power source, said alarm being activated whenever said second associated switch is opened.

8. The electrical circuit of claim 7 wherein activation of said reset switch shuts off said alarm.

9. The electrical circuit of claim 1 wherein said predetermined pressure is approximately −18 to −20 inches of mercury$_{gauge\ pressure}$.

* * * * *